United States Patent [19]

Swengel, Jr.

[11] 4,413,871

[45] Nov. 8, 1983

[54] EARTH CONNECTION CONNECTOR HAVING PROVISION FOR AN ELECTRICAL COMPONENT

[75] Inventor: Robert C. Swengel, Jr., York, Pa.

[73] Assignee: AMP Incorporated, Harrisburg, Pa.

[21] Appl. No.: 329,165

[22] Filed: Dec. 10, 1981

[51] Int. Cl.[3] ..... H01R 4/66

[52] U.S. Cl. ..... 339/14 R

[58] Field of Search ..... 339/14 R, 97 R, 98, 339/143 R, 147 R

[56] References Cited

U.S. PATENT DOCUMENTS

| | | | |
|---|---|---|---|
| 3,622,948 | 11/1971 | Foster | 339/147 R |
| 3,865,460 | 2/1975 | Cherney et al. | 339/98 |
| 4,029,384 | 6/1977 | Reinwall | 339/98 |
| 4,109,992 | 8/1978 | Hughes et al. | 339/147 R |
| 4,113,341 | 9/1978 | Hughes | 339/147 R |
| 4,272,147 | 6/1981 | Berglund et al. | 339/147 R |

*Primary Examiner*—Joseph H. McGlynn
*Assistant Examiner*—David Pirlot
*Attorney, Agent, or Firm*—Frederick W. Raring

[57] ABSTRACT

Electrical connector for connecting a ground conductor to a through conductor comprises an insulating housing on which is mounted a through conductor terminal having a wire receiving slot. The through conductor terminal is integral with a first tap conductor terminal located in a recess in the housing. A second tap conductor terminal is positioned in the recess and is spaced from the first terminal and a capacitor has its leads connected to the first and second terminals. The second terminal has an integral disconnect tap terminal which receives a terminal tab extending from a cover mounted on the housing. The cover serves as a section of the tap conductor and is bolted to a ground connection such as the frame of a motor vehicle.

7 Claims, 4 Drawing Figures

EARTH CONNECTION CONNECTOR HAVING PROVISION FOR AN ELECTRICAL COMPONENT

FIELD OF THE INVENTION

This invention relates to electrical connectors for making tap connections to through conductors and connecting a component such as a capacitor to the tap conductor.

BACKGROUND OF THE INVENTION

It is frequently desirable to connect one or more of the conductors in an automotive harness to ground or earth at an intermediate and convenient location along the length of the conductor and to connect a capacitor in series with the ground conductor. Connections of this type are required to suppress interference or noise produced in the electrical system of the vehicle which would interfere with the operation of radios or other communications equipment.

These tap-ground connections to the conductors in the harness can be made by stripping the insulation from the harness conductor, connecting one lead from the capacitor to the harness conductor, and connecting the other capacitor lead to the frame of the vehicle, however, this is a time-consuming task and requires stripping insulation from a portion of a conductor in the automotive harness. There is, therefore, the danger that some damage will be done to the harness when the connections are being made. The present invention is directed to the achievement of a connector which can be installed on a harness conductor without stripping installation therefrom and which can be directly connected to the automotive frame to form the ground connection. The connector moreover contains the required capacitor in a manner such that when the connector is installed on the harness conductor and secured to the frame, the ground connection is established.

A preferred embodiment of the invention comprises an electrical connector for connecting a first lead extending from a component to a through conductor and for connecting a second lead extending from a component to a tap conductor. The connector is of the type comprising an insulating housing having a recess extending inwardly from one surface thereof. The recess is dimensioned to receive the component (a capacitor) and first and second terminals. The first terminal has a wire receiving slot for reception of the first component lead and the second terminal has a wire receiving slot for reception of the second component lead. The connector is characterized in that a through conductor terminal is located beside the connector housing and proximate to the first terminal. The through conductor terminal has a wire receiving slot for reception of the through conductor and the through conductor terminal and the first terminal are connected to each other by an integral connecting section which extends through a wall of the connector housing. The second terminal has a tap conductor terminal integral therewith which is of the disconnect type and is dimensioned to receive a complementary disconnect type terminal upon movement of the complementary terminal into the housing recess. A sheet metal cover is provided for the recess and the complementary disconnect type terminal extends from this cover, the complementary terminal being located to mate with the tap conductor terminal when the cover is assembled to the housing in covering relationship to the recess. The sheet metal cover serves as the tap conductor and is bolted or otherwise connected to an earth terminal such as an automotive frame.

In accordance with further embodiments of the invention, the insulating housing has oppositely directed sidewalls and oppositely directed endwalls and the through conductor terminal is located beside one of the sidewalls. The tap conductor terminal which is integral with the second terminal in the housing is a receptacle terminal and the complementary terminal extending from the sheet metal cover is a terminal tab.

PREFERRED EMBODIMENT

Figure 1:
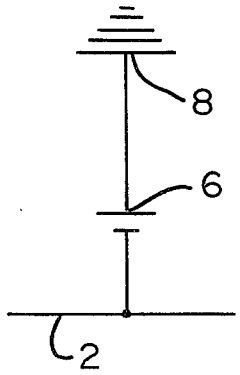
FIG. 1 is a diagram showing the type of electrical ground or earth connection formed with a connector in accordance with the invention.
Figure 2:
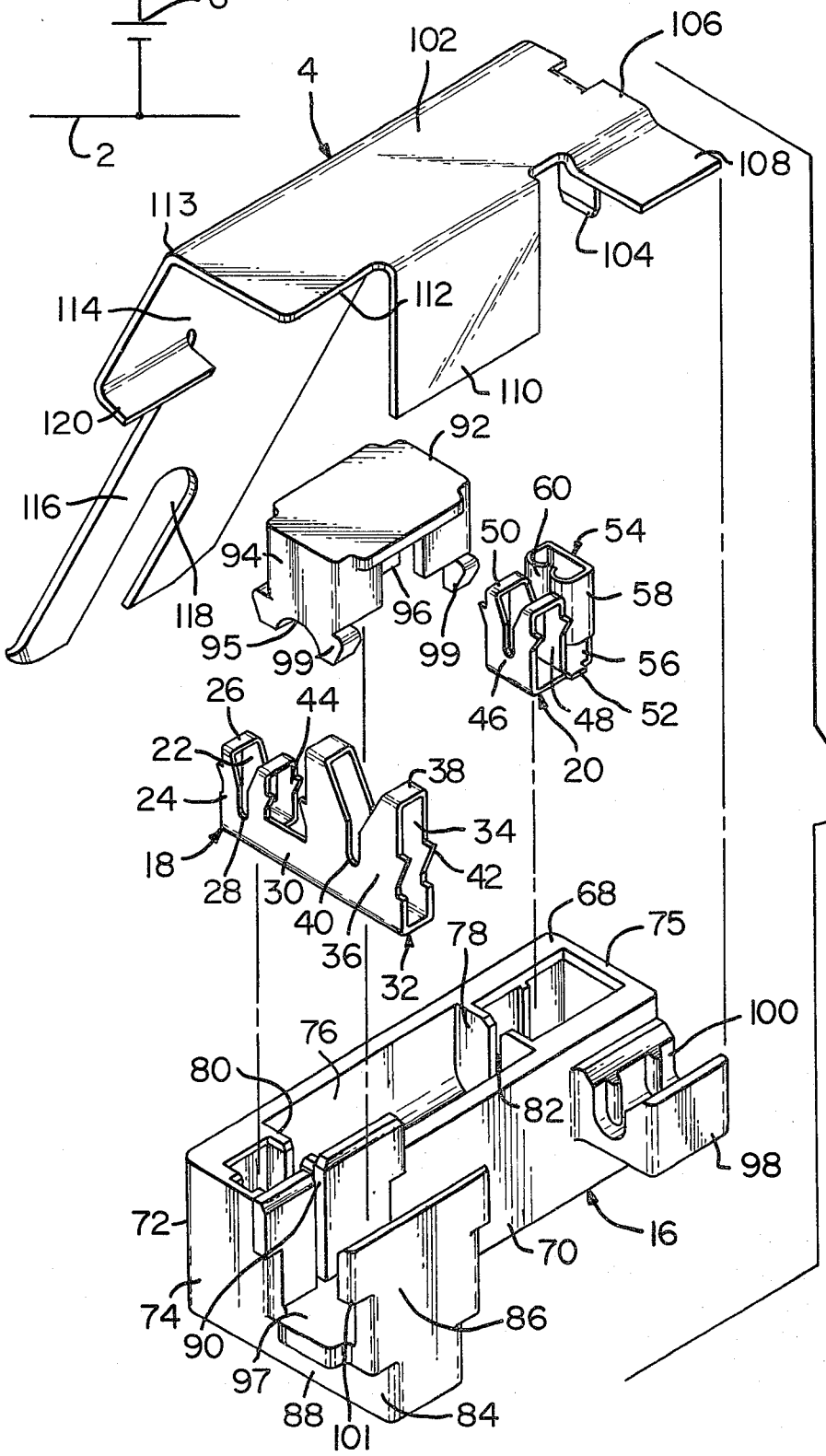
FIG. 2 is a perspective view of the parts of a connector with the terminals exploded from the housing and the cover exploded from the upper surface of the housing.

As shown in FIG. 1, a connector in accordance with the invention forms a tap connection to a through conductor 2 which will ordinarily be one of the harness conductors in a motor vehicle. The tap conductor contains a capacitor 6 and is connected to a ground potential location as indicated at 8. Ground connections to a through conductor of this type will eliminate or suppress noise in the through conductor 2 produced by sources such as the alternator of the vehicle. Such noise is objectionable because it interferes with radio reception.

Figure 3:
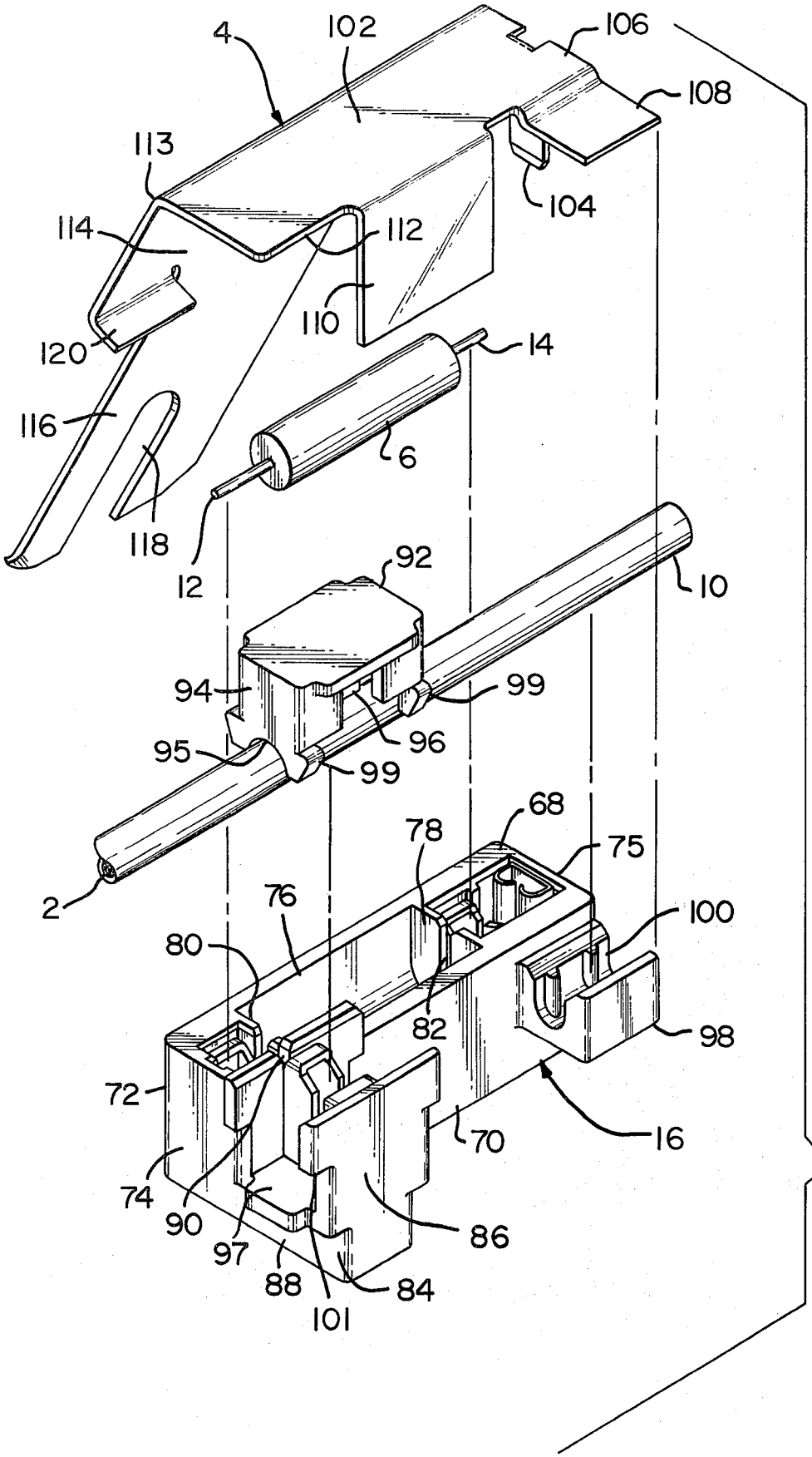
FIG. 3 is a view similar to FIG. 2 but showing the terminals assembled to the housing and showing the through conductor and the capacitor in alignment with the housing.

As shown in FIG. 3, the capacitor 6 is of the cylindrical type having first and second leads 12, 14 extending from its ends. The harness conductor or through conductor 2 is provided with insulation as shown at 10 which must be penetrated to establish contact with the through conductor. The connector 15 comprises a housing 16 and a cover indicated at 4, which serves as the tap conductor as will be explained below. The housing contains first and second terminals 18, 20. The first terminal 18 has spaced-apart platelike sections 22, 24 which are connected to each other by strap members 26. Wire receiving slots 28 extend into the platelike members so that when the first lead 12 is moved into these slots, electrical contact will be established with this lead.

A through conductor terminal 32 for the conductor 2 is integral with the first terminal 18 and connected thereto by a connecting section 30. The through conductor terminal is similar to the first terminal but of larger size for the larger harness conductor. The through conductor terminal thus has spaced-apart platelike members 34, 36 connected to each other by straps 38. The platelike members have wire receiving slots 40 dimensioned such that when the conductor 2 is moved downwardly from the position of FIG. 3 into the slots 40, the edges of the slots will penetrate the insulation 10 and establish contact with the core of the conductor 2.

The first terminal and the through conductor terminal are provided with barbs 42, 44 on their edges to retain the terminals in the insulating housing. These barbs penetrate the adjacent walls of the housing and prevent extraction of the terminals after they have been assembled to the housing as shown in FIG. 3. Similar barbs are provided on the second terminal 20.

The second terminal 20 is substantially similar to the terminal 18 and has platelike sections 46, 48, straps 50, and wire receiving slots, as shown, for the second lead 14 of the capacitor 6. A disconnect type terminal receptacle 54 is integral with the second terminal 20 and extends beside the platelike section 48. The terminal 54 is connected to the platelike member 46 by a flange 52 which extends beneath the platelike member 48. This flange is formed upwardly as shown at 56 and has sidewalls 58 which are curled inwardly, as shown at 60. The terminal 54 is dimensioned to receive the tab type terminal 104 which is integral with the cover 4 as described below.

The housing 16 is of molded thermoplastic material and has an upper surface 68, parallel sidewalls 70, 72 and endwalls 74, 75. A recess 76 extends inwardly from the upper surface 68 and barrier walls 78, 80 extend across this recess adjacent to the endwalls 74, 75. The barrier walls form cavities for the first and second terminals 18, 20 and the space between these barrier walls is sufficient to receive the cylindrical portion of the capacitor 6. The barrier walls are provided with slots 82 so that the capacitor 6 can be moved downwardly from the position of FIG. 3 and into the central portion of the recess. During such movement, the lead 12 will move into the wire receiving slots 28 of the first terminal 18 and the lead 14 will move into the wire receiving slots of the terminal 20.

The through wire terminal 32 is contained in a support 84 that partially encloses and surrounds the terminal. This support is integral with the sidewall 70 of the housing and comprises a vertically extending wall 86 that is connected to the sidewall 70 by an arm 88 extending from the sidewall 70 adjacent to the endwall 74. A slot 90 is provided in the sidewall 70 through which the connecting section 30 passes.

A cap or closure member 92 is fitted into the open upper end of the support 84 and has depending strain relief portions 94 adjacent to its ends. These strain relief portions 94 have arcuate lower surfaces 95 which bear against the through conductor and clamp it against the upper surface 97 of the arm or extension 88. The cap member 92 also has a depending wire stuffer 96 on its underside which retains the through conductor in the through conductor terminal 32. The cap 92 is retained in the support 84 by locking ears 99 which lodge beneath shoulders 101.

Figure 4:
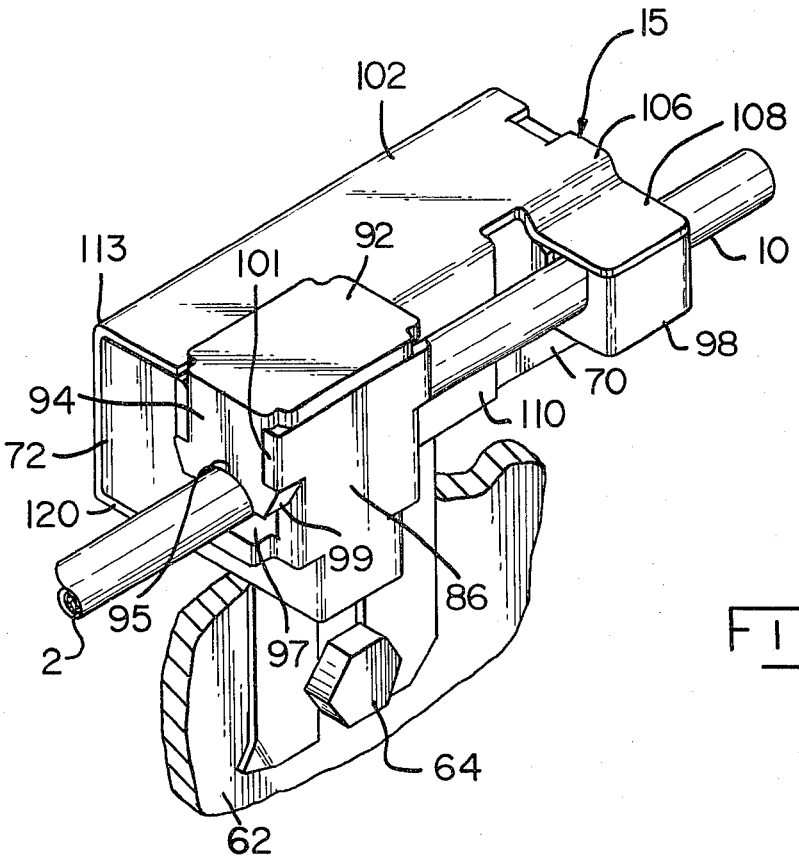
FIG. 4 is a perspective view of the assembled connector installed on a through conductor and bolted to an earth or ground potential location.

An additional strain relief means 98 extends from the sidewall 70 adjacent to the endwall 75 of the housing. This additional strain relief has a troughlike recess 100 which snugly receives the conductor 2, as shown in FIG. 4, so that the connector is securely held at two locations. The conductor 2 is retained in the recess 100 by an extension 108 of the cover 4 as shown in FIG. 4.

The cover is of stamped an formed sheet metal and has a rectangular section 102 that is dimensioned to extend over the upper surface 68 of the housing. The previously identified ear or extension 108 extends from the side edge 112 of the cover adjacent to one end 106 thereof. The tab terminal 104 depends from the flat section 102 adjacent to the same end 106 and is located such that it will enter the receptacle terminal 54 when the cover is moved downwardly from the position of FIG. 3. A depending flange 110 extends from the side edge 112 and is against the sidewall 70 of the housing when the cover is assembled to the housing. A flange 114 extends from the side edge 113 and has a bracket portion 116 on its lower end so that it can be mounted, as shown in FIG. 4, on the automotive frame. The cover may be secured to the frame by means of a bolt or screw 64 threaded into the frame 62. The cover 4 is maintained on the housing by means of an ear 120 which extends inwardly from the left hand portion of the flange 114 and bears against the downwardly facing surface of the housing. If required, additional securing means can be provided, such as fasteners, to secure the cover to the housing.

The connector at the time of installation will have the component 6 contained in the recess 76 and the component leads 12, 14 will be connected to the terminals in the housing. The technician in installing the connector simply moves the conductor 2 downwardly from the position of FIG. 3 until it extends through the slots 40 of the terminal 32 and an adjacent portion of the conductor is positioned in the recess 100. Thereafter, the cap 92 is assembled to the terminal support 84 and the lid or cover 4 is assembled to the housing. The flange 114 is bent inwardly at this time so that the housing is snugly held between the flanges 110, 114. The bracket portion 116 of the cover is then bolted as shown at 64 to the frame to complete the connection.

It will be apparent that by the use of the connector 15, the ground connection to the conductor 2 can be made in a minimum of time and without any risk of causing damage to the circuit served by the conductor 2.

What is claimed is:

1. An electrical connector for connecting a first lead extending from a component, such as a capacitor, to a through- conductor and for connecting a second lead extending from the component to a tap conductor, the connector being of the type comprising an insulating housing having a recess extending inwardly from one surface thereof, the recess being dimensioned to receive the component and first and second terminals, the first terminal having a wire-receiving slot therein for reception of the first component lead and the second terminal having a wire receiving slot for reception of the second component lead, the connector being characterized in that:

a through conductor terminal is located beside the housing and proximate to the first terminal, the through conductor terminal having a wire-receiving slot for reception of the through conductor, the through conductor terminal and the first terminal being connected to each other by a connecting section which extends through a wall of the housing, the second terminal has a tap conductor terminal integral therewith, the tap conductor terminal being of the disconnect type and being dimensioned to receive a complementary disconnect type terminal upon movement of the complementary terminal into the recess, a sheet metal cover is provided for the recess, the cover having the complementary disconnect type terminal extending therefrom and located to mate with the tap conductor terminal when the cover is assembled to the housing in covering relationship to the recess, the sheet metal cover being the tap conductor whereby, upon placement of the component in the recess with the first and second leads received in the wire-receiving slots of the first and second terminals, and upon placement of the through conductor in the wire-receiving slot of the through conductor terminal, and upon assembly of the cover to the housing, the first lead of the component will be connected to the through conductor and the second lead of the component will be connected to the tap conductor.

2. An electrical connector as set forth in claim 1 characterized in that the housing has oppositely directed sidewalls on each side of the one surface, the through conductor terminal being located beside one of the sidewalls and the connecting section extending through the one sidewall.

3. An electrical connector as set forth in claim 2 characterized in that the housing has first and second endwalls, the first and second terminals being adjacent to the endwalls.

4. An electrical connector as set forth in claim 3 characterized in that the tap conductor terminal is a receptacle terminal, the complementary disconnect type terminal being a tab terminal.

5. An electrical connector as set forth in claim 4 characterized in that the cover has integral flanges extending from its side edges, the flanges extending over the sidewalls of the housing.

6. An electrical connector as set forth in claim 5 characterized in that one of the flanges has a mounting bracket portion extending therefrom for mounting the connector on a ground conductive member.

7. An electrical connector as set forth in claim 6, characterized in that the one sidewall beside which the through conductor terminal is located has a supporting portion for the through conductor terminal, the through conductor terminal being supported in the supporting portion.

* * * * *